US005125398A

United States Patent [19]

Horton

[11] Patent Number: 5,125,398

[45] Date of Patent: Jun. 30, 1992

[54] PERSONAL HYGIENIC MASSAGE BAR

[76] Inventor: Azor R. Horton, P.O. Box 246, Inkster, Mich. 48141

[21] Appl. No.: 707,758

[22] Filed: May 30, 1991

[51] Int. Cl.[5] ..... A61H 1/00

[52] U.S. Cl. ..... 128/32; 128/36; 128/62 R; 128/61

[58] Field of Search ..... 128/32, 34-36, 128/59-62 R, 67

[56] References Cited

U.S. PATENT DOCUMENTS 3,358,309 12/1967 Richardson ..... 128/36
3,623,481 11/1971 Curran ..... 128/36
3,671,785 6/1972 Fuch et al. ..... 128/36 X
3,812,848 5/1974 Kollitz ..... 128/36
4,027,348 6/1977 Flowers et al. ..... 128/62 R
4,052,981 10/1977 Bachmann ..... 128/36
4,116,233 9/1978 Scaduto ..... 128/57 X
4,787,372 11/1988 Ramseyer ..... 128/62 R X
4,887,594 12/1989 Siegel ..... 128/36

*Primary Examiner*—Robert A. Hafer
*Assistant Examiner*—Brian E. Hanlon
*Attorney, Agent, or Firm*—Richard C. Litman

[57] ABSTRACT

A personal hygienic massage bar for cleansing the facial or body parts include a device built into the bar for massaging the facial and/or body parts. The massaging effect is accomplished by a motor which drives an off-centered weighted flywheel. The hygienic bar also includes a variable timer, which is activated by an internal motion switch. An internal power supply supplies to the above motor and timer.

15 Claims, 2 Drawing Sheets

PERSONAL HYGIENIC MASSAGE BAR

FIELD OF THE INVENTION

This invention relates to a hygienic bar that has included therein a device for further cleansing the facial and body parts. This device gives the user the ability to further clean his/her body by having bristles for massaging the skin. An additional massaging effect is accomplished by a motor which rotates an off-centered weighted disk.

DESCRIPTION OF THE RELATED ART

Personal massage devices are known in the art. Examples are U.S. Pat. Nos. 4,919,177; 2,489,582; 4,295,240; 3,358,309; 3,943,921 and 3,812,848 to Muchisky et al., Lex, Richardson, Curran, Colk and Kolitz respectively. Other massage device for cleansing body parts is taught by U.S. Pat. No. 2,007,107 to Bottrill. None of the above patents discloses nor suggest applicant's invention of combining vibrator means and bristles inside a personal hygienic bar.

SUMMARY OF THE INVENTION

The present invention provides a user with the ability to clean and massage facial or body parts. An object of the present invention is to combine a personal hygienic bar with means, that when activated, will start a vibrator.

Another object of the present invention is to provide a personal hygienic bar with a tab to activate a motor.

Still another object of the present invention is to provide a personal hygienic bar with a motion trip switch.

A further object of the present invention is to provide a personal hygienic bar with a variable timer circuit which can be activated by a motion trip switch.

A still further object of the present invention is to provide a personal hygienic bar with a motor that drives an off-centered weighted disk which creates vibration within the bar.

These and other objects regarding the features on the instant invention will become apparent to those skilled in the art, such as, using a different trip switch or power source in combination with a different means for creating a vibration.

BRIEF DESCRIPTION ON THE DRAWINGS

DESCRIPTION OF THE PREFERRED EMBODIMENT

Figure 1:
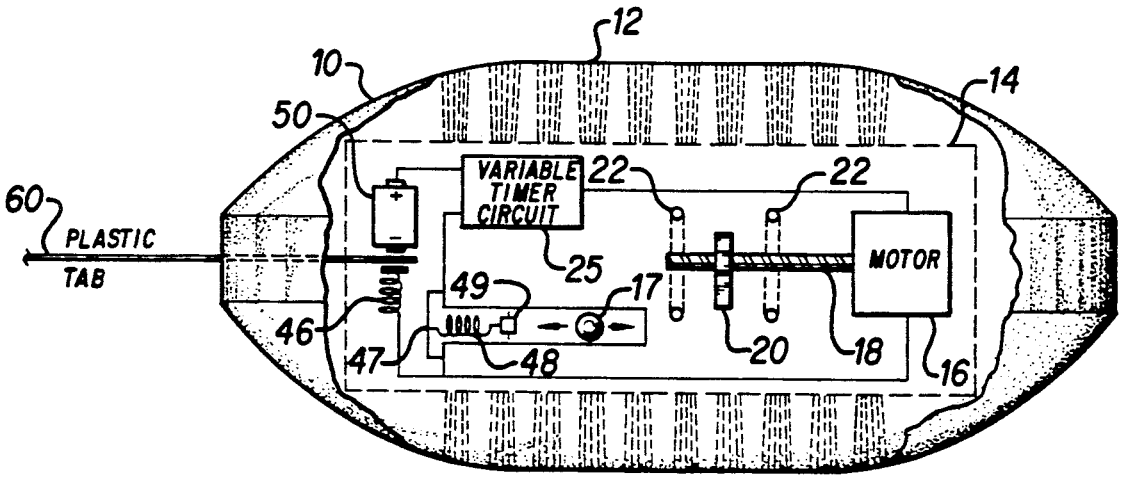
FIG. 1 shows a front view of a personal hygienic massage bar with a device for vibrating being embedded therein.
Figure 2:
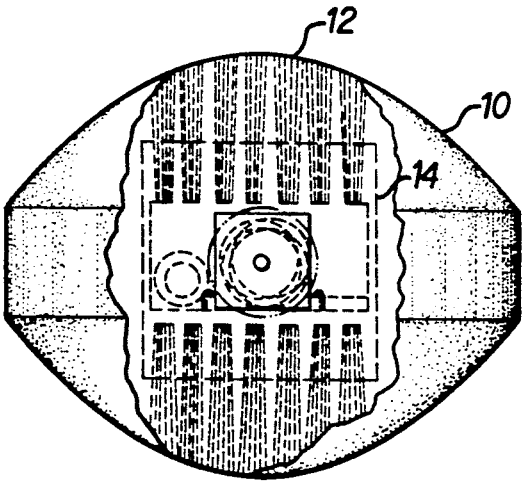
FIG. 2 shows an end view of a personal hygienic massage bar with a device for vibrating being embedded therein.

Referring to FIGS. 1 and 2, there is shown a personal hygienic massage bar 10, which is used for cleansing either the facial or body parts. The cleansing is accomplish by vibration and by bristles 12. A "Hygienic Bar" is being defined as any type of bar of soap, deodorant, facial cleaner, make - up remover, etc. The vibration is accomplished by using a motor 16, which is connected via a drive shaft 18, to drive an off-centered weighted disk 20. Two supports 22 are used to stabilize the driven shaft 18. The motor 16 is powered by a power source 50. The power source 50 may be a 9 volt battery, which is non - replaceable. Other types of power sources may be used. When the hygienic massage bar 10 has been completely used, the housing 14, which contains the massage device, may be returned to the manufacture for replacement.

The motor 16 receives its power from the power source 50 through a variable timer circuit 25. The timer circuit 25, which is known in the art, for example, a 555 timer with a trigger input, controls the power to the motor 16 for a limited time, upon activation. Different time durations may be set by the manufacture. The activation is accomplished by a motion switch 47. The motion switch 47 is closed when a steel ball 17 pushes contact 49 towards a closed position. A spring 48 keeps contact 49 biased toward an open position, such that the timer circuit 25 is not tripped by causal movement of the hygienic bar. As shown in FIG. 1, the switch 47 is connectable to a negative side of the power supply 50. A plastic tab 60 is removeablely embedded into the hygienic bar 10 so as to prevent the power source 50 from powering the motor 16 during shipment. When the plastic tab 60 is removed a spring contact 4 extends to the negative side of the power source 50 to complete the electrical circuit from the motor 16 to the power source 50. Furthermore when the tab 60 is removed, a closing device(not shown) closes off the housing 14, such that the housing 14 prevents water from entering.

When a person wishes the bar 10 to vibrate, all that is needed is to give the bar 10 a firm shake. By shaking the bar 10, the ball 17 pushes contact 49 to a momentary close position. This action triggers the timer 25 to provide power from the power source 50 to the motor 16.

Figure 3A:
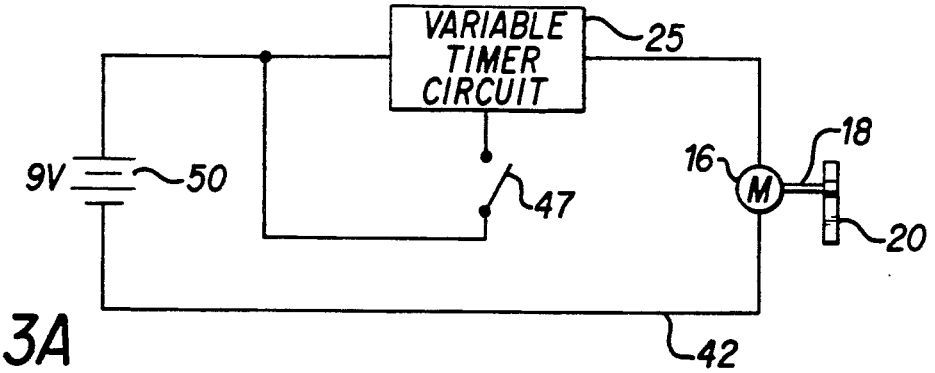
FIGS. 3A-3D show schematics of the vibration circuit.
Figure 3B:
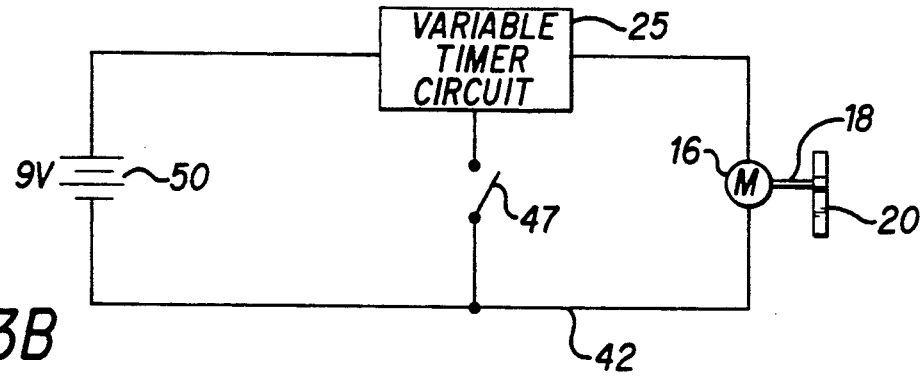
Figure 3C:
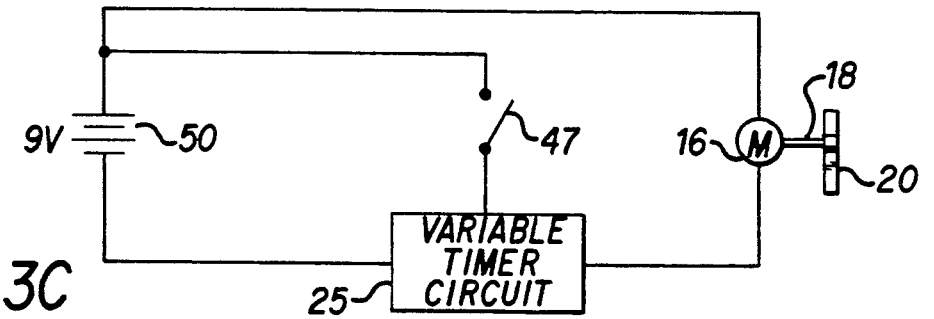
Figure 3D:
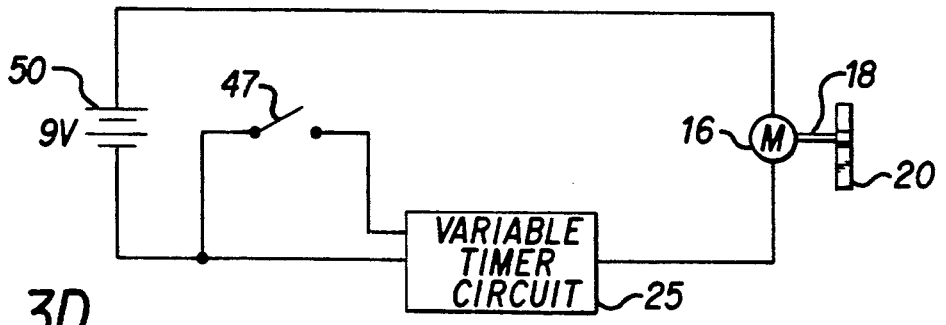

Referring to FIGS. 3A-3D, shown are different schematic circuits for powering the motor 16. FIG. 3B corresponds to FIG. 1. However the timer circuit 25 may connected to the negative side of the power source 50. Furthermore the trigger input may come from either the positive side of the power source 50 or the negative side of the power source 50. The operation of the motor ,however, remains the same regardless of the connection of the timer circuit 25 and trigger input.

Although the instant invention has been described with respect to specific details of certain preferred embodiments thereof, it is not intended that such details limit the scope of the instant invention, except insofar as is set forth in the following claims.

I claim:

1. A combination cleansing and massaging device for cleaning facial or body parts comprising:

a housing enclosing;

vibrator means for massaging facial or body parts, power supply means for powering said vibrator means, variable timer means for supplying power from said power supply means to said vibrator means, a motion switch for controlling said variable timer means; and a personal hygienic bar having embedded therein said housing which includes said vibrator means, said power supply means, said variable timer means and said motion switch.

2. A combination as described in claim 1 wherein said vibrator means includes a motor being connected to receive power from said power supply means.

3. A combination as described in claim 2 wherein said vibrator means further includes an off-centered weighted disk which is driven by said motor.

4. A combination as described in claim 1 wherein said motion switch is activated by the movement of a steel ball 9, which is movable inside said hygienic bar.

5. A combination as described in claim 4 wherein said motion switch is connectable to a negative side of the power supply means.

6. A combination as described in claim 1 wherein said power supply is a non-replaceable battery.

7. A combination as described in claim 6 wherein said vibrator means further include stationary means for stabilizing said disk while it is being driven by said motor.

8. A combination as described in claim 7 further includes tab means to prevent said power supply means from powering said vibrator means.

9. A combination as described in claim 8 wherein said tab means is removable from said bar to allow power from said power supply means to power said vibrator means.

10. A combination cleansing and massaging device for cleaning facial or body parts comprising:

vibrator means for massaging facial or body parts, power supply means for powering said vibrator means, variable timer means for supplying power from said power supply means to said vibrator means, a motion switch for controlling said variable timer means, tab means being placed between a negative side of said power supply means and a spring contact to prevent said power supply means from powering said vibrator means; and a personal hygienic bar having embedded therein said vibrator means, said power supply means, said variable timer means, said motion switch and said tab means.

11. A combination as described in claim 10 wherein said motion switch is connectable to a negative side of the power supply means.

12. A combination as described in claim 11 wherein said motion switch is activated by the movement of a steel ball 9, which is movable inside said bar.

13. A combination as described in claim 10 wherein said vibrator means includes a motor being connected to receive power from said power supply means.

14. A combination as described in claim 10 wherein said vibrator means includes an off-centered weighted disk which is driven by a motor.

15. A combination as described in claim 10 wherein said motion switch is activated by the movement of a steel ball 9, which is movable inside said bar.

* * * * *